US010035075B2

(12) United States Patent
Chantrell et al.

(10) Patent No.: US 10,035,075 B2
(45) Date of Patent: Jul. 31, 2018

(54) VEHICLE TRACK ELEMENT

(71) Applicant: Dreamup Toys LLC, East Lyme, CT (US)

(72) Inventors: Thomas J. Chantrell, East Lyme, CT (US); Richard Schlueter, Clinton, CT (US)

(73) Assignee: Dreamup Toys, LLC, East Lyme, CT (US)

( * ) Notice: Subject to any disclaimer, the term of this patent is extended or adjusted under 35 U.S.C. 154(b) by 545 days.

(21) Appl. No.: 14/670,944

(22) Filed: Mar. 27, 2015

(65) Prior Publication Data

US 2015/0283472 A1 Oct. 8, 2015

Related U.S. Application Data

(60) Provisional application No. 61/971,732, filed on Mar. 28, 2014.

(51) Int. Cl.

| | |
|---|---|
| ***A63H 19/36*** | (2006.01) |
| ***A63H 33/08*** | (2006.01) |
| ***A63H 19/30*** | (2006.01) |
| ***A63H 19/34*** | (2006.01) |

(52) U.S. Cl.

CPC ..... *A63H 19/36* (2013.01); *A63H 19/30* (2013.01); *A63H 19/34* (2013.01); *A63H 33/086* (2013.01)

(58) Field of Classification Search

CPC ..... A63H 19/30; A63H 18/02; A63H 19/34; A63H 33/062; A63H 19/36; A63H 33/08; A63H 33/086

See application file for complete search history.

(56) References Cited

U.S. PATENT DOCUMENTS

| | | | |
|---|---|---|---|
| 4,403,733 | A | 9/1983 | Bach et al. |
| 4,826,076 | A | 5/1989 | Hesse |
| D344,307 | S | 2/1994 | Ruszkai |
| 5,454,513 | A | 10/1995 | Wilson |
| 6,126,506 | A | 10/2000 | Rudy |

(Continued)

OTHER PUBLICATIONS

Forthofer, Jason, "Episode 92—Review of Lego Passenger Train" The Brick Show, Oct. 5, 2010 (May 10, 2010), Accessed from <http://blip.tv/the-brick-show/lego-passenger-train-review-lego-7938-4298764>, entire video, especially 9:44-10:02.

(Continued)

*Primary Examiner* — Zachary L Kuhfuss

(74) *Attorney, Agent, or Firm* — Duquette Law Group, LLC

(57) ABSTRACT

A track element includes a base having a first side and a second side opposing the second side, the first side of the base defining a set of wheel engagement elements and the second side of the base defining first and second locking block receptacles at the first and second ends of the base, respectively. The track element includes a first track element connector disposed at the first end of the base and a second track element connector disposed at the second end of the base. The first locking block receptacle is configured to receive a first locking block to define a first support for a first track piece and the second locking block receptacle is configured to receive a second locking block to define a second support for a second track piece.

20 Claims, 18 Drawing Sheets

(56) References Cited

U.S. PATENT DOCUMENTS

| | | | | |
|---|---|---|---|---|
| 6,155,177 | A * | 12/2000 | Backfisch | A63H 19/30<br>104/124 |
| 6,616,500 | B1 | 9/2003 | Harms et al. | |
| 2003/0089789 | A1 * | 5/2003 | Rothkopf | A63H 18/02<br>238/10 E |
| 2013/0126628 | A1 | 5/2013 | DiBartolo et al. | |
| 2014/0134915 | A1 | 5/2014 | Wilson | |

OTHER PUBLICATIONS

International Search Report dated Jul. 13, 2015 from corresponding International Application No. PCT/US2015/022972.

* cited by examiner

VEHICLE TRACK ELEMENT

RELATED APPLICATIONS

This patent application claims the benefit of U.S. Provisional Application No. 61/971,732, filed on Mar. 28, 2014, entitled, "Vehicle Track Platform," the contents and teachings of which are hereby incorporated by reference in their entirety.

BACKGROUND

Children have enjoyed playing with track and vehicle sets, such as wooden trains, for many years. These track and vehicle sets combine the construction of the track with the imaginative play associated with the vehicles that traverse the track.

SUMMARY

Conventional track and vehicle sets suffer from a variety of deficiencies. For example, existing wooden toy train sets can be an expensive investment. Furthermore, the child's interest and enthusiasm for wooden train play thereafter often requires the purchase of additional track pieces and expansion kits, track accessories, and vehicle destinations/stations which are a further expense for parents. Many times, these track systems have proprietary connections that force parents to continue to purchase a particular brand at a premium price.

In addition, existing toy train sets include track pieces that are configured to remain on a single level (e.g., on a support or playing surface such as a table or a floor). Certain toy train sets include track pieces that can be assembled to form a train track that extends above the playing surface by two or more levels. For example, users can position and assemble certain track pieces over and above other track pieces that are supported by the support surface. However, with conventional toy train sets, elevation of conventionally non-elevated track pieces is typically done in a makeshift manner by the child. Any track layouts having configurations of more than two levels can be unstable, unusable, and non-entertaining due to the track collapsing.

By contrast to conventional track and vehicle sets, embodiments of the present innovation relate to a vehicle track element configured to be used in creating both non-elevated and elevated track layouts and destinations for toy vehicles. For example, the vehicle track element is configured to be disposed substantially flat against a play surface to allow the connection of track pieces having male or female track element connectors on the play surface level. The vehicle track element is also configured with locking block receptacles that connect with corresponding locking block elements to dispose the track element at a variable distance above the play surface. The relative positioning of the locking block elements and the male or female track element connectors of the track element provides a support surface for track pieces connected to the vehicle track element. Accordingly, the configuration of the vehicle track element allows a user to connect conventional slotted train tracks with conventional locking blocks or bricks to create elevated and substantially stable train track scenarios and to create unique track configurations.

In one arrangement, a track element, includes a base having a first side and a second side opposing the second side, the first side of the base defining a set of wheel engagement elements extending between a first end and a second end of the base and the second side of the base defining a first locking block receptacle at the first end of the base and a second locking block receptacle at the second end of the base. The track element includes a first track element connector disposed at the first end of the base and a second track element connector disposed at the second end of the base. The first locking block receptacle is configured to receive a first locking block to define a first support for a first track piece coupled to the first track element connector and the second locking block receptacle is configured to receive a second locking block to define a second support for a second track piece coupled to the second track element connector.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

Embodiments of the present innovation relate to a vehicle track element configured to be used in creating both non-elevated and elevated track layouts and destinations for toy vehicles. For example, the vehicle track element is configured to be disposed substantially flat against a play surface to allow the connection of track pieces having male or female track element connectors. The vehicle track element is also configured with locking block receptacles that connect with corresponding locking block elements to dispose the track element at a variable distance above the play surface. The relative positioning of the locking block elements and the male or female track element connectors of the track element provides a support surface for track pieces connected to the vehicle track element. Accordingly, the configuration of the vehicle track element allows a user to connect conventional slotted train tracks with conventional locking blocks or bricks to create elevated and substantially stable train track scenarios and to create unique track configurations.

Figure 1:
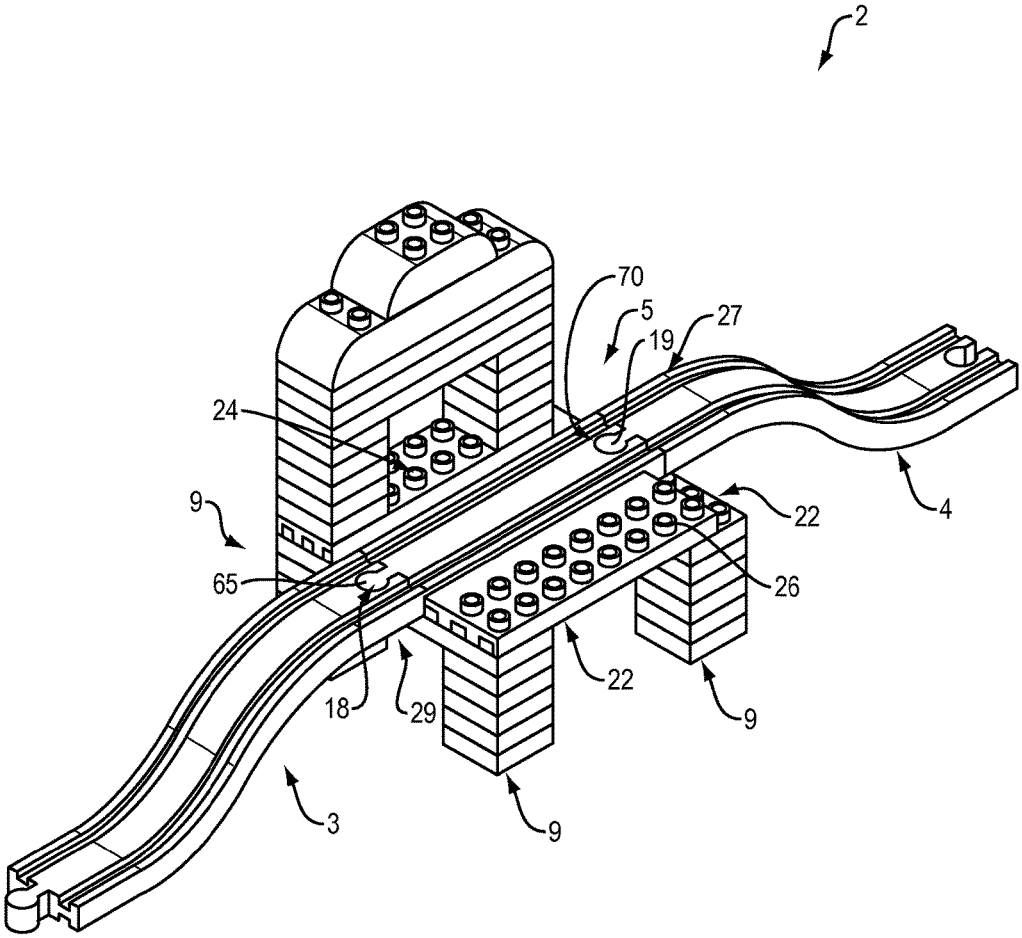
FIG. 1 illustrates a track system, according to one arrangement.

FIG. 1 illustrates a track system 2 that includes a track element 5 and conventional track pieces 3, 4 coupled to the opposing ends of the track element 5. Additionally, the system 2 includes locking block elements 9 coupled to the track element 5. The locking block elements 9, such as DUPLO or LEGO blocks, are configured to attach with the track element 5 to support the track element 5 at an elevated distance from a base playing surface, such as a table or floor. The locking block elements 9 are also configured to mate with first and second ends 27, 29 of the track element 5. Such a configuration supports the first and second ends 27, 29 of the track element 5, as well as the ends of the track elements 3 and 4, at an elevated distance above the play surface.

FIGS. 2-5 illustrate the track element 5 of FIG. 1, according to one example arrangement. The track element 5 includes a base 6 having a longitudinal axis 7, a lateral axis 8, and a vertical axis 9.

The base 6 includes a first end 10 and a second end 11 which opposes the first end. In one arrangement, a first track element connector 16 is disposed at the first end 10 of the base 6, while a second track element connector 17 is disposed at the second end 11 of the base 6, relative to the longitudinal axis 7. The first and second track element connectors 16, 17 of the track element 5 can connect to conventional wooden track pieces 3, 4 such as those offered by BRIO, MELISSA & DOUG, and Imaginarium, for example, when the track element 5 and conventional wooden track pieces 3, 4 are both configured to remain flat on the play surface.

While the first track element connector 16 can be configured in a variety of way, in one arrangement, the first track element connector 16 is configured as a male connector element 65 extending from a first sidewall 64 of the base 6. For example, the male connector element 65 includes a substantially straight rectangular section 66 and a wider, substantially cylindrical portion 68, disposed at the distal end of the straight section 66. With such a configuration, the male connector element 65 is configured to connect with a corresponding female connector structure 18 of a conventional track piece, as shown in FIG. 1. It is noted that the size and shape of the male connector element 65 is provided by way of example only and that the size and shape of the male connector element 65 is not limited to that illustrated and described herein.

Returning to FIGS. 2-5, while the second track element connector 17 can be configured in a variety of ways, in one arrangement, the second track element connector 17 is configured as a female connector element 70 defined by a second sidewall 72 of the base 6. For example, relative to the vertical axis 9, the second sidewall 72 defines a substantially rectangular neck portion 74 and a wider, substantially cylindrical portion 76, extending from the neck portion 74. With such a configuration, the female connector element 70 is configured to connect with a corresponding male connector structure 19 of a conventional track piece, as shown in FIG. 1. It is noted that the size and shape of the female connector element 70 is provided by way of example only and that the size and shape of the female connector element 70 is not limited to that illustrated and described herein.

Figure 2:
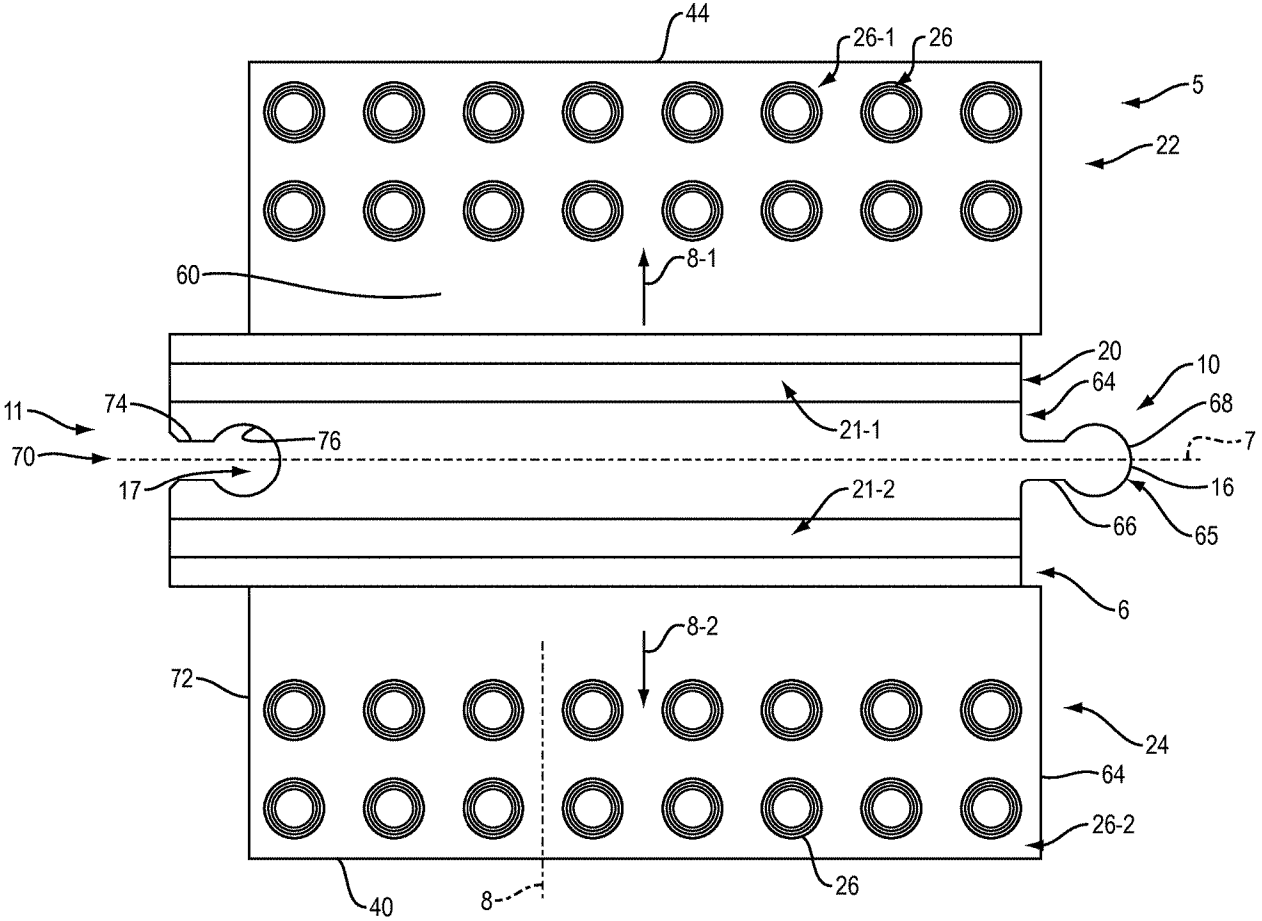
FIG. 2 illustrates a top view of a track element, according to one arrangement.
Figure 4:
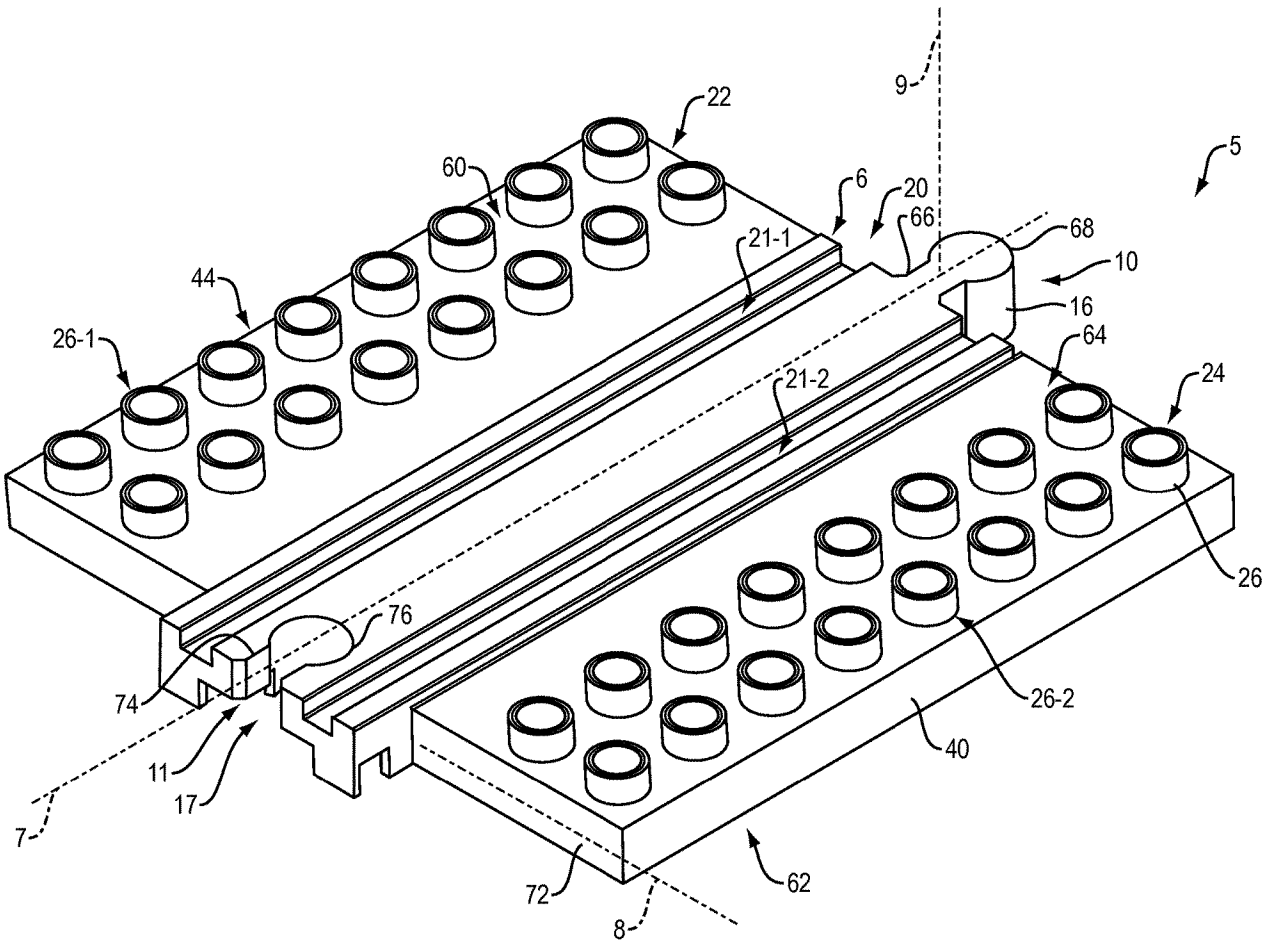
FIG. 4 illustrates a top perspective view of the track element of FIG. 2, according to one arrangement.

The base 6 further has a first, or top, side 60 and a second, or bottom, side 62 that opposes the first side 60. With reference to FIGS. 2 and 4, the first side 60 of the base 6 defines a set of wheel engagement elements 20 that are configured as a track surface for use with a toy vehicle, such as a toy train. In one arrangement, the wheel engagement portions 20 are configured as substantially parallel first and second channels or slots 21-1, 21-2 defined by, and extending along, the base 6 between the first end 10 and the second end 11 of the base 6. In use, the channels 21 are configured to receive the wheels of a toy train to guide the train along the track element 5. In one arrangement, such as when the base 6 is a wood material, manufacturers can mill or otherwise cut the channels 21 into a top side 60 of the base 6. Alternately, depending upon the material from which the base 6 is formed (e.g., plastic or metal), a manufacturer can form the channels 21 using a molding process.

It should be understood that the wheel engagement elements 20 can be configured in many other ways, depending upon the type of toy vehicles to be used. For example, for different types of toy trains, raised rails may be formed extending longitudinally along the base 6. Alternately, the base 6 may be formed to be substantially flat or to have a single wide groove formed therein to represent a road along which toy automobiles and trucks are run.

Figure 3:
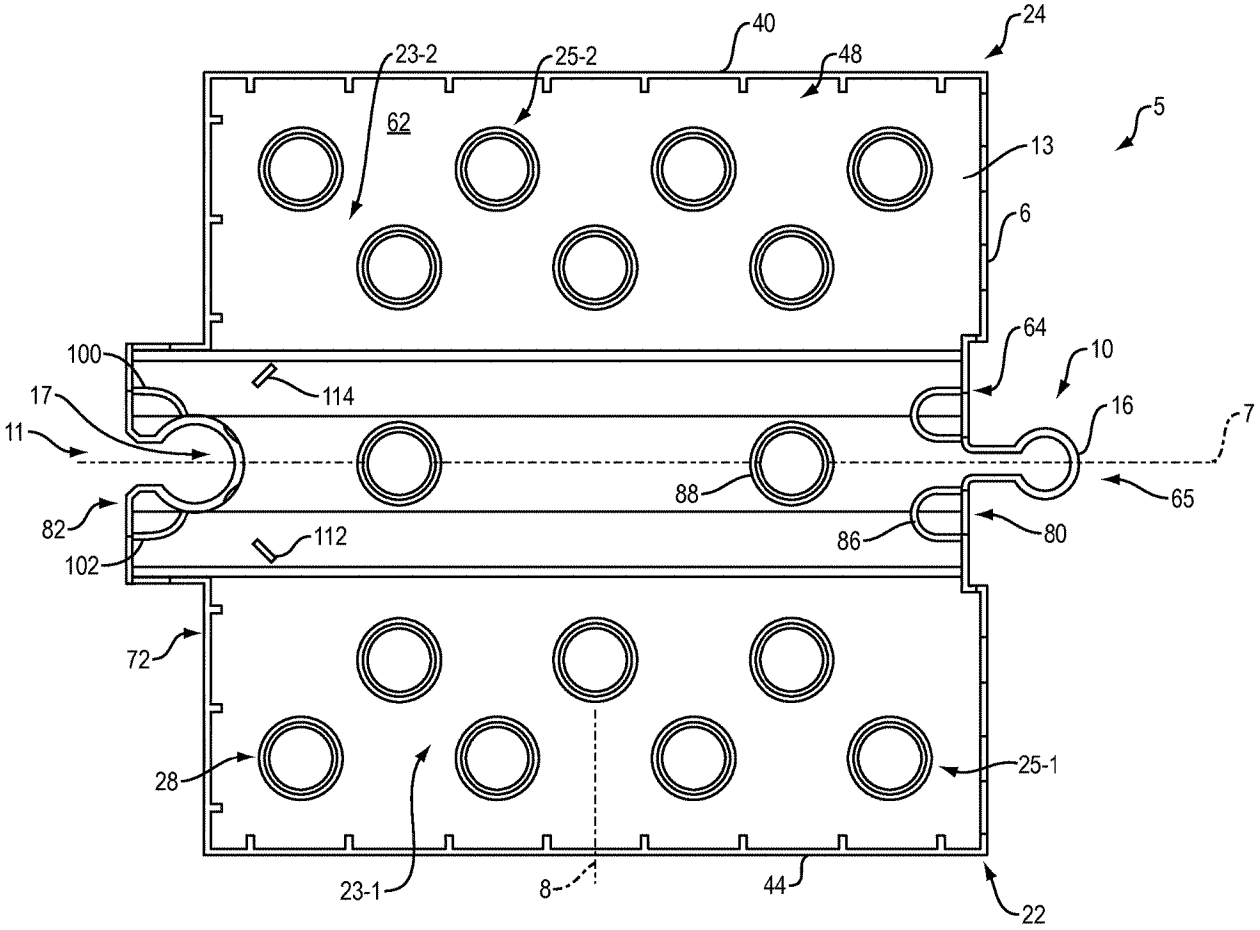
FIG. 3 illustrates a bottom view of the track element of FIG. 2, according to one arrangement.
Figure 5:
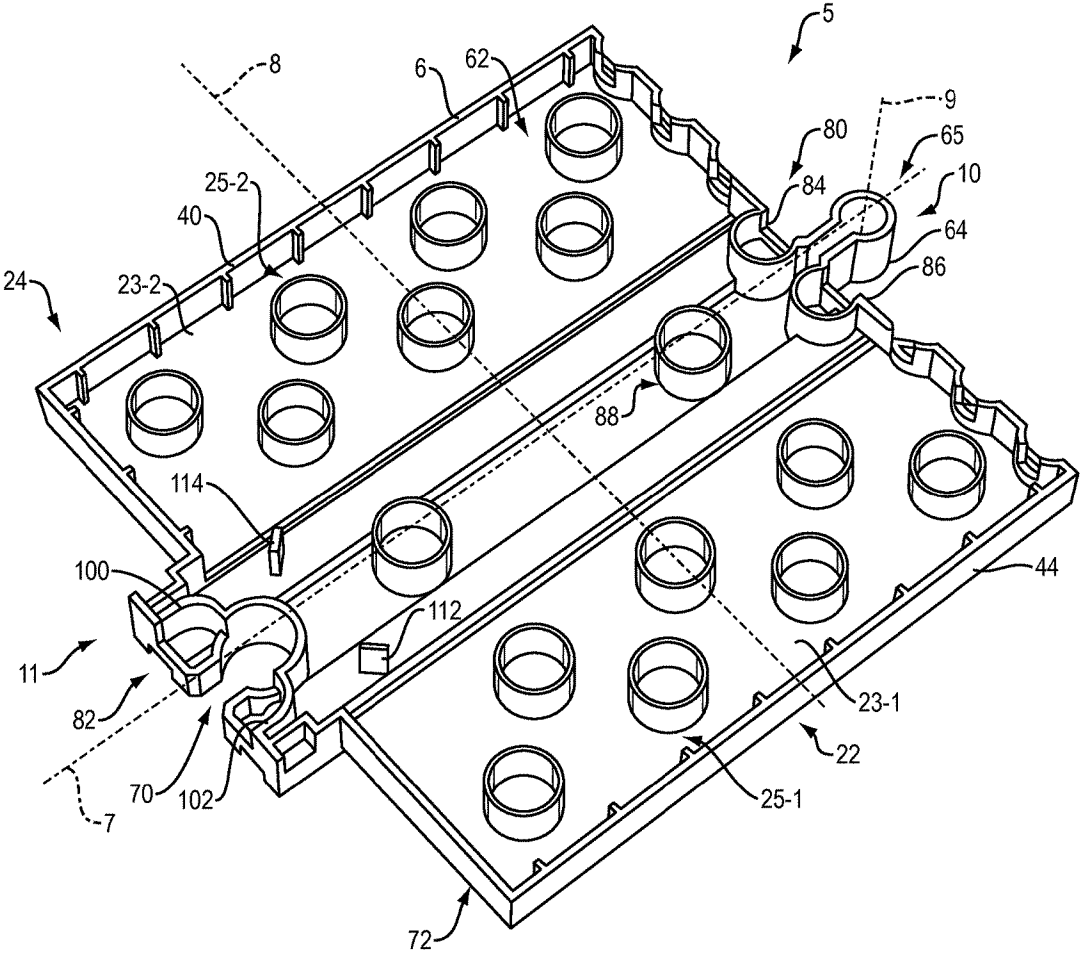
FIG. 5 illustrates a bottom perspective view of the track element of FIG. 2, according to one arrangement.

With reference to FIGS. 3 and 5, the first and second ends 10, 11 of the second side 62 of the base 6 are configured to interconnect with projections of conventional locking building blocks and bricks such as DUPLO or MEGA brand bricks, to support track pieces at an elevated, lateral distance above a play surface. For example, the second side 62 of the base 6 defines a first locking block receptacle 80 at the first end 10 of the base 6 and a second locking block receptacle 82 at the second end 11 of the base 6. As will be described below, the first locking block receptacle 80 is configured to receive a first locking block to define a first support for a track piece coupled to the male connector element 65 while the second locking block receptacle 82 is configured to receive a second locking block to define a second support for a track piece coupled to the female connector element 70.

As shown in FIGS. 3 and 5, for example, the first locking block receptacle 80 defines a first receiver 84 and a second receiver 86 extending from the second side 62 of the base 6. While the first and second receivers 84, 86 can be configured in a variety of ways, in one arrangement, each of the first and second receivers 84, 86 are shaped as substantially cylindrical structures defining respective openings therein. The first receiver 84 is configured to receive a first projection from a locking block and the second receiver 86 is configured to receive a second projection from the locking block.

Figure 6:
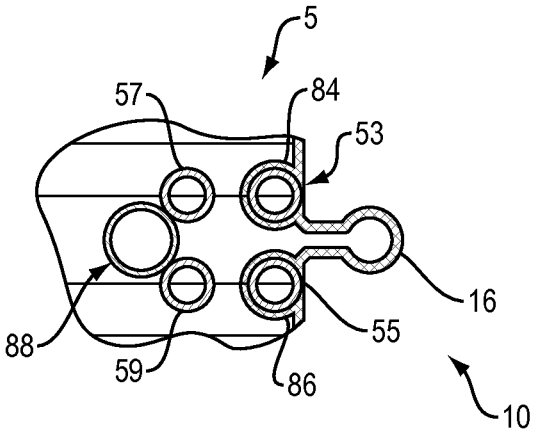
FIG. 6 illustrates a bottom view of the track element of FIG. 2 having a first locking block receptacle, according to one arrangement.

For example, FIG. 6 illustrates a top view of the second side 62 of the base 6 having the first and second receivers 84, 86. In this view, the first and second projections 53, 55 of a locking block, illustrated as an overlay, are disposed within the openings defined by the first and second receivers 84, 86. With such positioning of the first and second projections 53, 55, the third and fourth projections 57, 59 of the locking block are disposed against a first end projection 88 of the base 6, such as in a friction fit manner. In such an arrangement, the interaction between the projections 53, 55, 57, 59 of the locking block with the first and second receivers 84, 86 and with the first end projection 88 maintain a substantially secure attachment (e.g., friction fit) between the locking block and the track element 5.

Further, with the first and second projections 53, 55 disposed within the openings defined by the first and second receivers 84, 86, the first and second receivers 84, 86 are configured to dispose a vertical face of the locking block at a first offset distance from the first sidewall 64 of the base 6.

Figure 8:
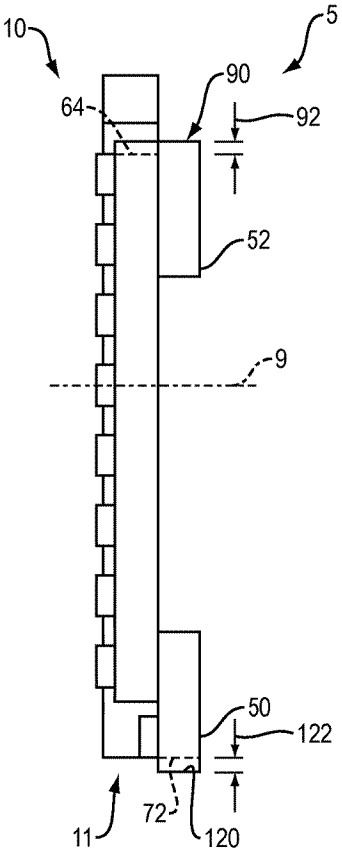
FIG. 8 is a side view of the track element of FIG. 2 having first and second locking elements coupled thereto, according to one arrangement.
Figure 7:
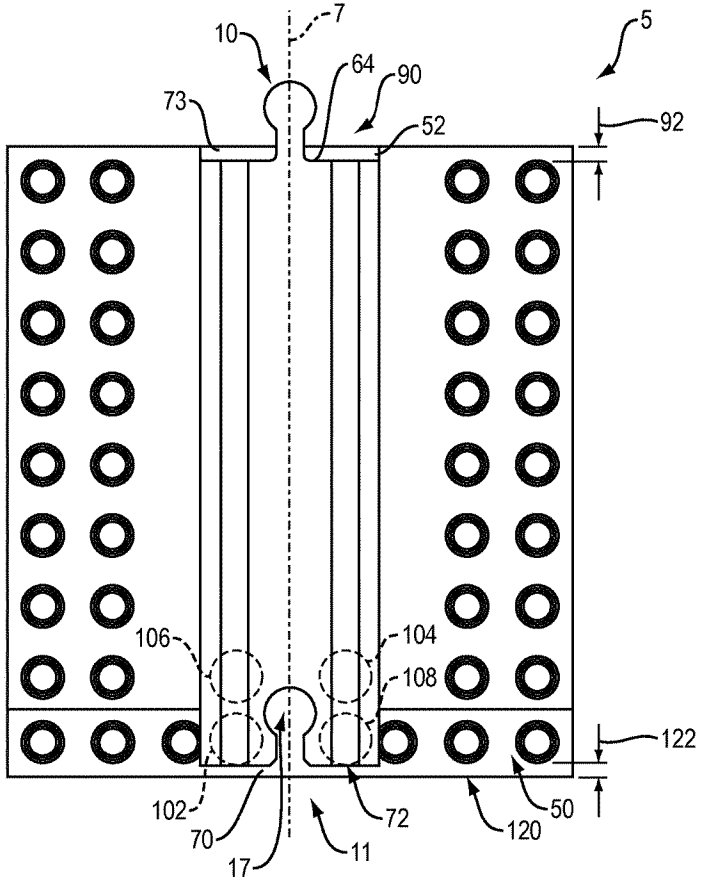
FIG. 7 is a top view of the track element of FIG. 2 having first and second locking elements coupled thereto, according to one arrangement.

For example, FIGS. 7 and 8 illustrate the track element 5 having a first locking block 52 coupled to the first locking block receptacle 80 described above. The first locking block includes a vertical face 90 which extends along, and is substantially parallel to, vertical axis 9. As indicated, based upon the positioning of the projections 53, 55, 57, 59 of the locking block 52 with the first locking block receptacle 80, the first locking block receptacle 80 disposes the vertical face 90 at a distance 92 from the first sidewall 64 of the base 6 to define a support area 73 for a female connector structure 18 of a conventional track piece 3. Interaction between a female connector structure 18 of a conventional track piece 3 and the support area 73 defined by the first locking block receptacle 80 and the first locking block 52 is illustrated in FIGS. 9-12. While the support area 73 can be configured as a variety of distances, in one arrangement, the support area 73 is configured as having a distance 92 of about 0.12 inches between the vertical face 90 and the first sidewall 64.

With respect to the second locking block receptacle 82, returning to FIGS. 3 and 5, the second locking block receptacle 82 defines a first receiver 100 and a second receiver 102 extending from the second side 62 of the base 6. While the first and second receivers 100, 102 can be configured in a variety of ways, in one arrangement, each of the first and second receivers 100, 102 are shaped as substantially semi-circular structures defining respective openings therein. The first receiver 100 is configured to receive a first projection from a second locking block and the second receiver 102 is configured to receive a second projection from the second locking block.

Figure 13:
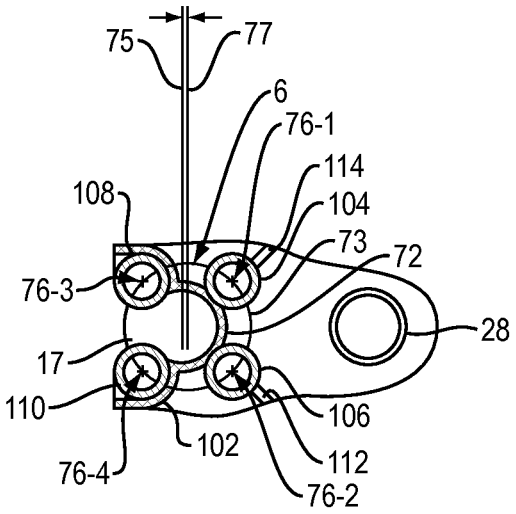
FIG. 13 illustrates a bottom view of the track element of FIG. 2 having a second locking block receptacle, according to one arrangement.

For example, FIG. 13 illustrates a top view of a portion of the second side 62 of the base 6 having the first and second receivers 100, 102. In this view, the projections 108, 110 of a locking block, illustrated as an overlay, are disposed within the openings defined by the first and second receivers 100, 102 while projections 104, 106 are disposed between the second end wall 72 and supports 112, 114. In such an arrangement, the interaction between the projections 104, 106, 108. 110, the first and second receivers 100, 102, and the supports 112, 114 maintains a substantially secure attachment (e.g., friction fit) between the locking block and the track element 5.

Further, with additional reference to FIGS. 7 and 8, the second locking block receptacle 82 is configured to dispose a vertical face 120 of a second locking block 50, which extends along, and is substantially parallel to, vertical axis 9, at an offset distance 122 from the second sidewall 72 of the base 6. The second locking block receptacle 82 is configured to support locking block 50 to define a support area 70 to carry a male connector structure 19 of a conventional track element 4. In one arrangement, the second locking block receptacle 82 defines such a support area by substantially aligning a center of the projections 104, 106, 108, 110 with a center of the female connector element 17.

Figures 9, 10, 11, 12:
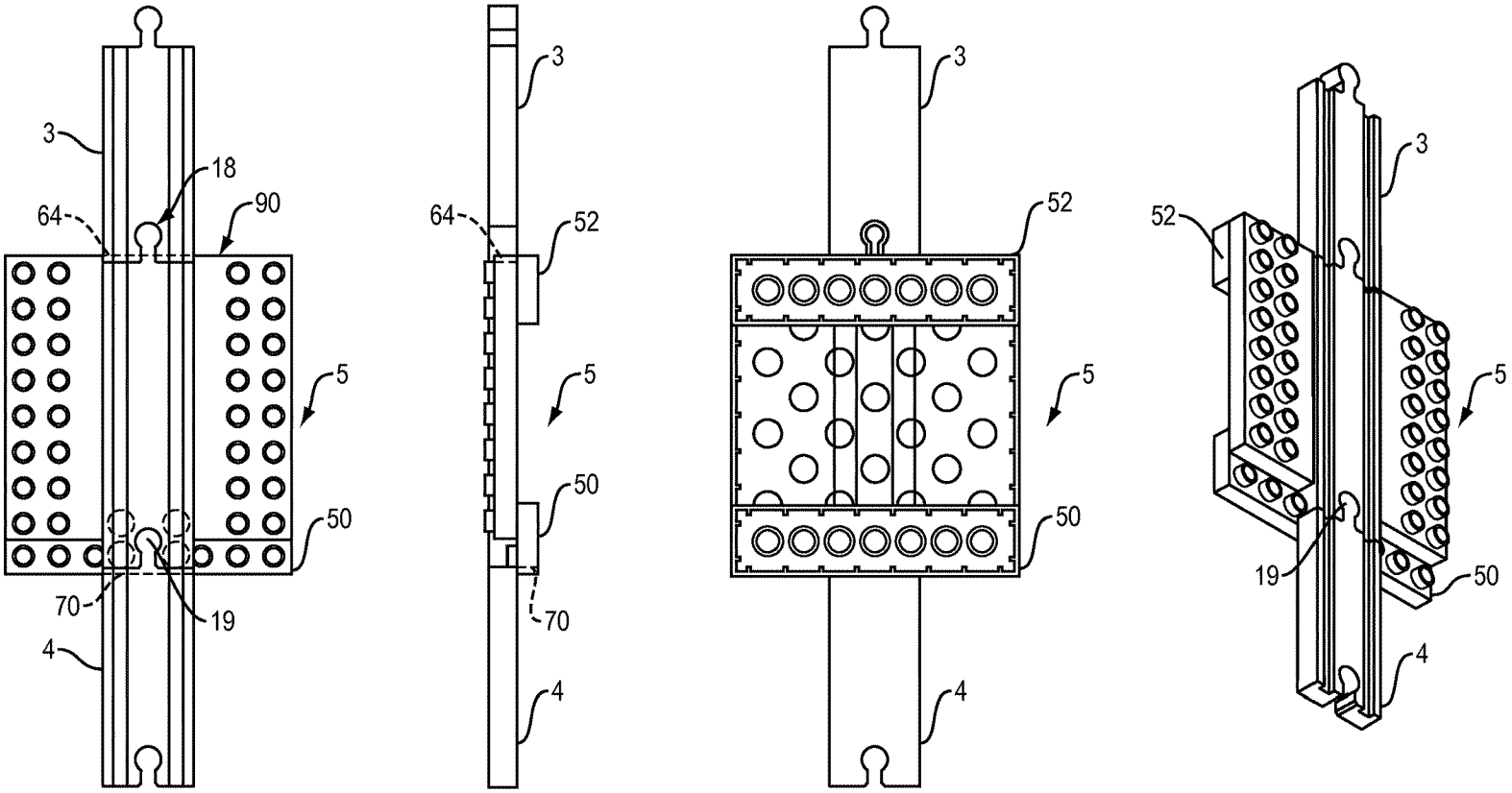
FIG. 9 is a top view of the track element of FIG. 2 having first and second track elements coupled thereto, according to one arrangement.
FIG. 10 is a side view of the track element of FIG. 2 having first and second track elements coupled thereto, according to one arrangement.
FIG. 11 is a bottom view of the track element of FIG. 2 having first and second track elements coupled thereto, according to one arrangement.
FIG. 12 is an isometric view of the track element of FIG. 2 having first and second track elements coupled thereto, according to one arrangement.

For example, with reference to FIG. 13, at the second end 11, the female connector structure 17 defines a first center point 75. Further, the center points 76-1, 76-2, 76-3, 76-4 of each projection 104, 106, 108, 110 of a connected locking block define a circle 73 having a second center point 77. The second locking block receptacle 82 is configured to substantially align the first center point 75 with the second center point 77 when the user couples the track element 5 to the locking block 50. For example, the first and second center points 75, 77 can be disposed at a distance of about 0.040 inches from each other. This allows the male connector structure 19 of a track piece 4 (as shown in FIG. 9) to be captured by both the female connector structure 17 and the projections 104, 106, 108, 110 of the interlock block 50. Interaction between the male connector structure 19 of a conventional track piece 4 and the support area 70 defined by the second locking block receptacle 82 and the second locking block 50 is illustrated in FIGS. 9-12. In such as arrangement, a neck element of the male connector structure 19 of the track piece 4 is disposed between adjacent projections 104, 106, 108, 110 of the locking block 50.

Figure 14:
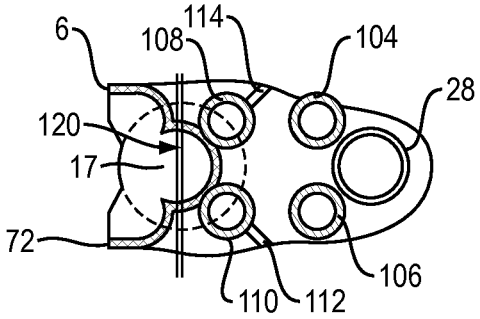
FIG. 14 illustrates a bottom view of the track element of FIG. 2 having a second locking block receptacle, according to one arrangement.

In another example, FIG. 14 illustrates a top view of the second side 62 of the base 6. As shown in this view, the projections 108, 110 of a locking block, illustrated as an overlay, are disposed between the second end wall 72 and the supports 112, 114 while projections 104, 106 are disposed adjacent to and against a second end projection 28. In such an arrangement, the interaction between the projections 104, 106 and the second end wall 72 and the supports 112, 114, as well as between the projections 108, 110 and the second end projection 28 maintains a substantially secure attachment (e.g., friction fit) between the locking block 50 and the track element 5.

Figure 15:
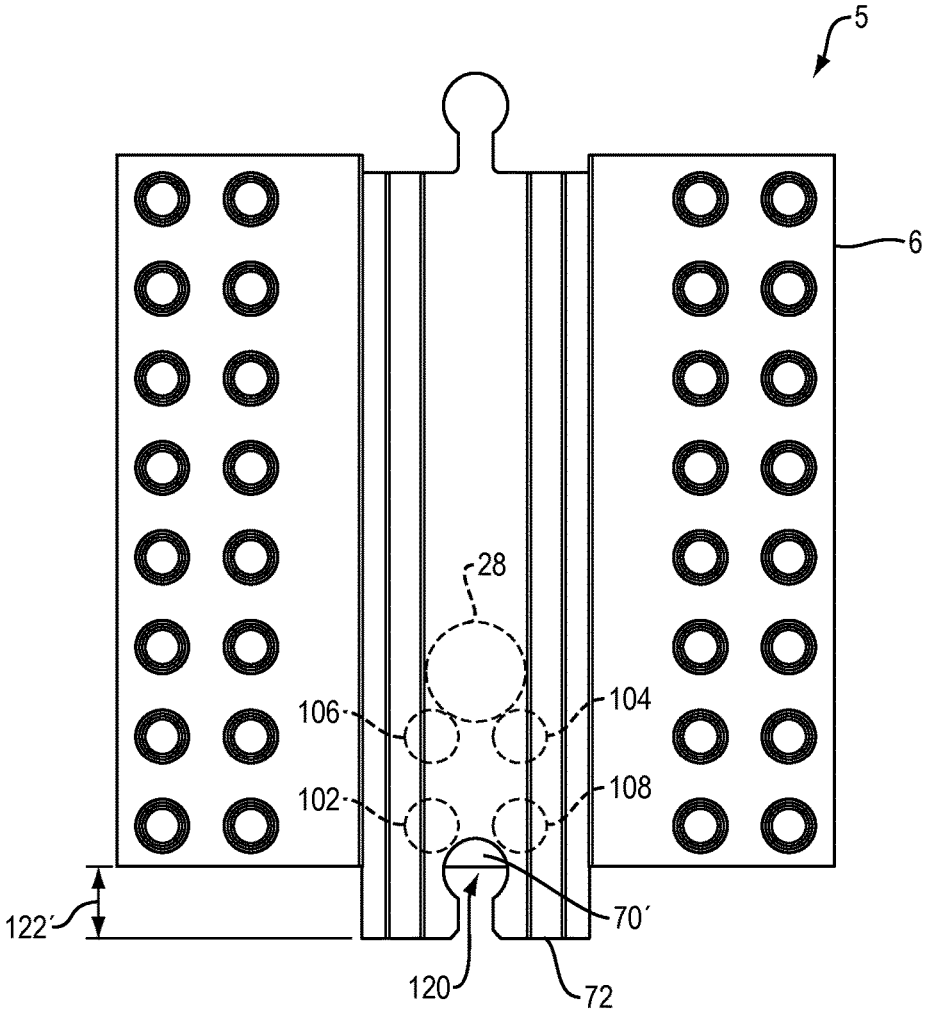
FIG. 15 illustrates one configuration in which a locking element is positioned to support the head element of the male portion of a track element.

Further, with additional reference to FIG. 15, the second locking block receptacle 82 is configured to dispose a vertical face 120 of the second locking block 50 at an offset distance 122' from the second sidewall 72 of the base 6. As illustrated, the second locking block receptacle 82 is configured to support the locking block 50 to define a support area 70' to carry a portion of a male connector structure 19 of a conventional track element 4. In such as arrangement, a head element of the male connector structure 19 of the track piece 4 can abut adjacent projections 108, 110 of the locking block 50.

In the arrangement described above, the track element 5 is configured such that the first and second track element connectors 16, 17 and the corresponding locking blocks 52, 50 support the female and male connectors 18, 19, respectively, of corresponding track pieces 3, 4 when the track element 5 is elevated above a play surface. Accordingly, the configuration of the vehicle track element 5 allows a user to connect conventional slotted train track pieces 3, 4 with conventional locking blocks or bricks 50, 52 to create elevated and substantially stable train track scenarios.

Returning to FIGS. 1-5, in one arrangement, the base 6 of the track element 5 can further include opposing first and second platform portions 22, 24 that extend along the lateral axis 8. For example, the first platform portion 22 can extend along a first lateral direction 8-1 relative to a longitudinal axis 7 of the base 6 and the second platform portion 24 can extend along a second lateral direction 8-2 relative to the longitudinal axis 7 of the base 6 where the second lateral 8-2 direction opposes the first lateral direction 8-1.

The first, or top, side 60 of the platform portions 22, 24 can include projections 26. For example, the first platform portion 22 of the base 6 includes a set of first platform portion locking block projections 26-1 and the second platform portion 24 of the base 6 includes a set of second platform portion locking block projections 26-2. The first and second platform portion locking block projections 26-1, 26-2 extend along the vertical axis 9 of the base 6 and are positioned in a desired manner to interconnect by a friction fit when pressed together with commonly used locking blocks and bricks, such as DUPLO or MEGA brand bricks. The projections 26-1, 26-2 allow a user to securely add locking blocks to the top side of the base 6 to create unique structures, as shown in FIG. 1.

The second, or bottom, side 62 of the platform portions 22, 24 is configured to interconnect with projections of conventional locking building blocks and bricks 50, 52, such as DUPLO or MEGA brand bricks. For example, the base 6 includes opposing first and second sidewalls 64, 72 as well as opposing third and fourth sidewalls 40, 44 that extend from the second side 62 and that define a cavity 48. The second, or bottom, side 62 of the platform portions 22, 24 includes projections configured to interconnect with locking blocks by a friction fit. For example, with reference to FIGS. 3 and 5 the first platform portion 22 includes secondary projections 25-1 that define a set of first platform portion locking block receptacles 23-1 and the second platform portion 24 includes secondary projections 25-2 that define a set of second platform portion locking block receptacles 23-2. The secondary projections 25 extend along the vertical axis 9 and while the projections 28 can be configured with a variety of shapes, in one arrangement, the projections 28 are configured as cylindrical structures. The projections 25-1, 25-2 and receptacles 23-1, 23-2 allow a user add locking blocks to the bottom side of the base 6 to help stabilize the track element 5 when disposed at a distance above a play surface, as shown in FIG. 1.

While various embodiments of the innovation have been particularly shown and described, it will be understood by those skilled in the art that various changes in form and details may be made therein without departing from the spirit and scope of the innovation as defined by the appended claims.

As indicated above, the first track element connector 16 is configured as a male connector element 65 and the second track element connector 17 is configured as a female connector element 70. Such indication is by way of example only. In one arrangement, the first and second track element connectors 16, 17 are both configured as male connector elements 65. In one arrangement, the first and second track element connectors 16, 17 are both configured as female connector elements 70.

Figure 16:
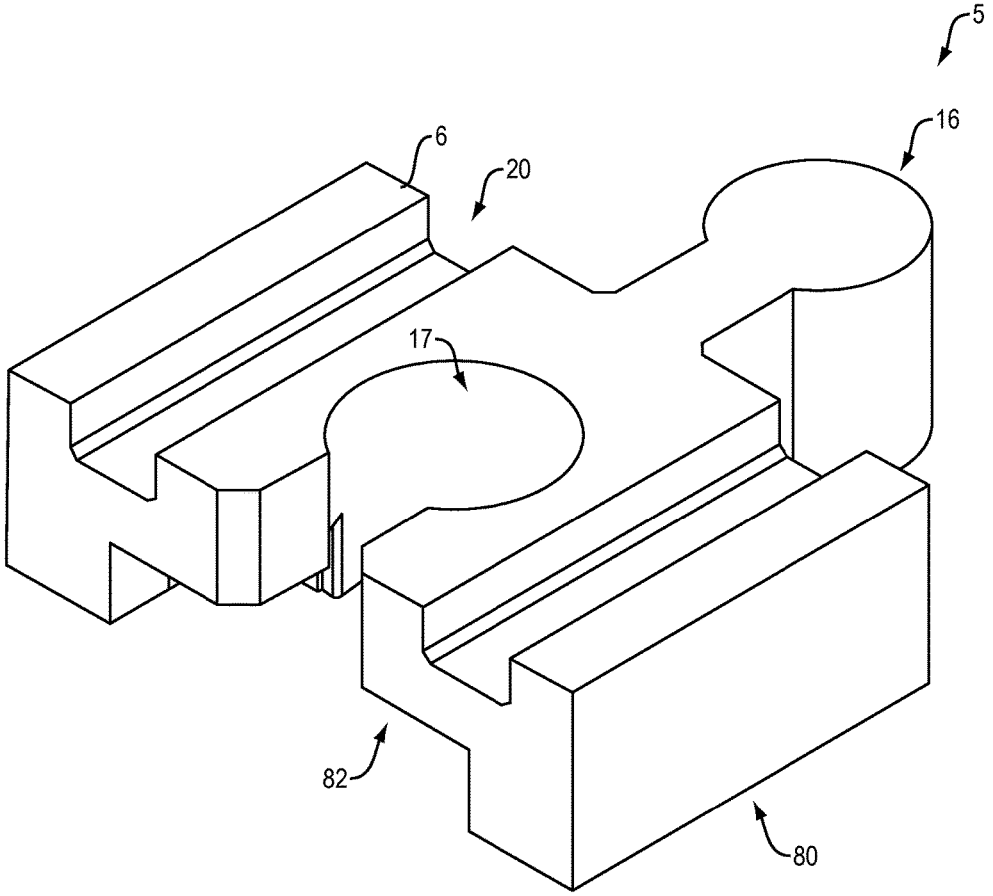
FIG. 16 illustrates a track element, according to one arrangement.

As indicated above, the track element 5 is described as having opposing first and second platform portions 22, 24. Such description is by way of example only. In one arrangement, as illustrated in FIG. 16, the track element 5 includes the base 6, wheel engagement elements 20, first and second track element connectors 16, 17, and first and second locking block receptacles 80, 82.

Figure 17:
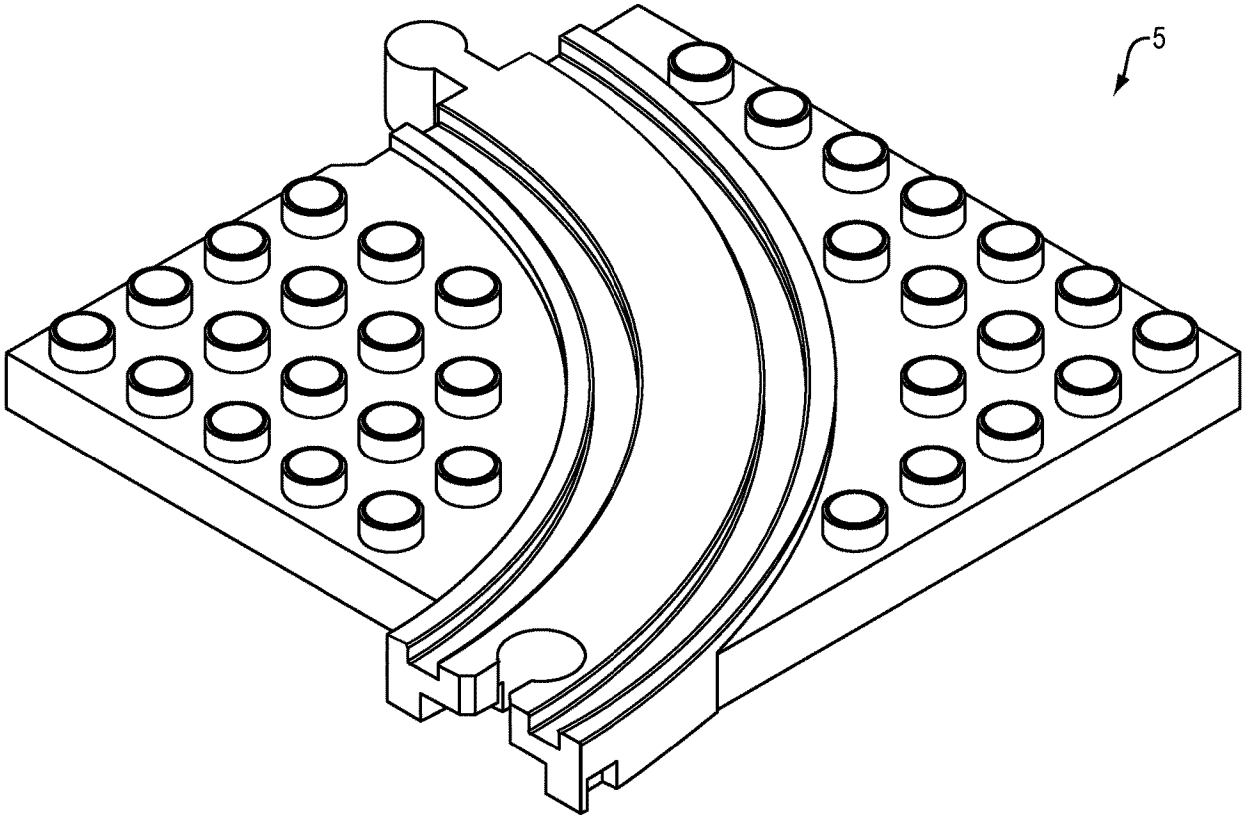
FIG. 17 illustrates a track element having wheel engagement elements disposed in a substantially 90° curve.
Figure 18:
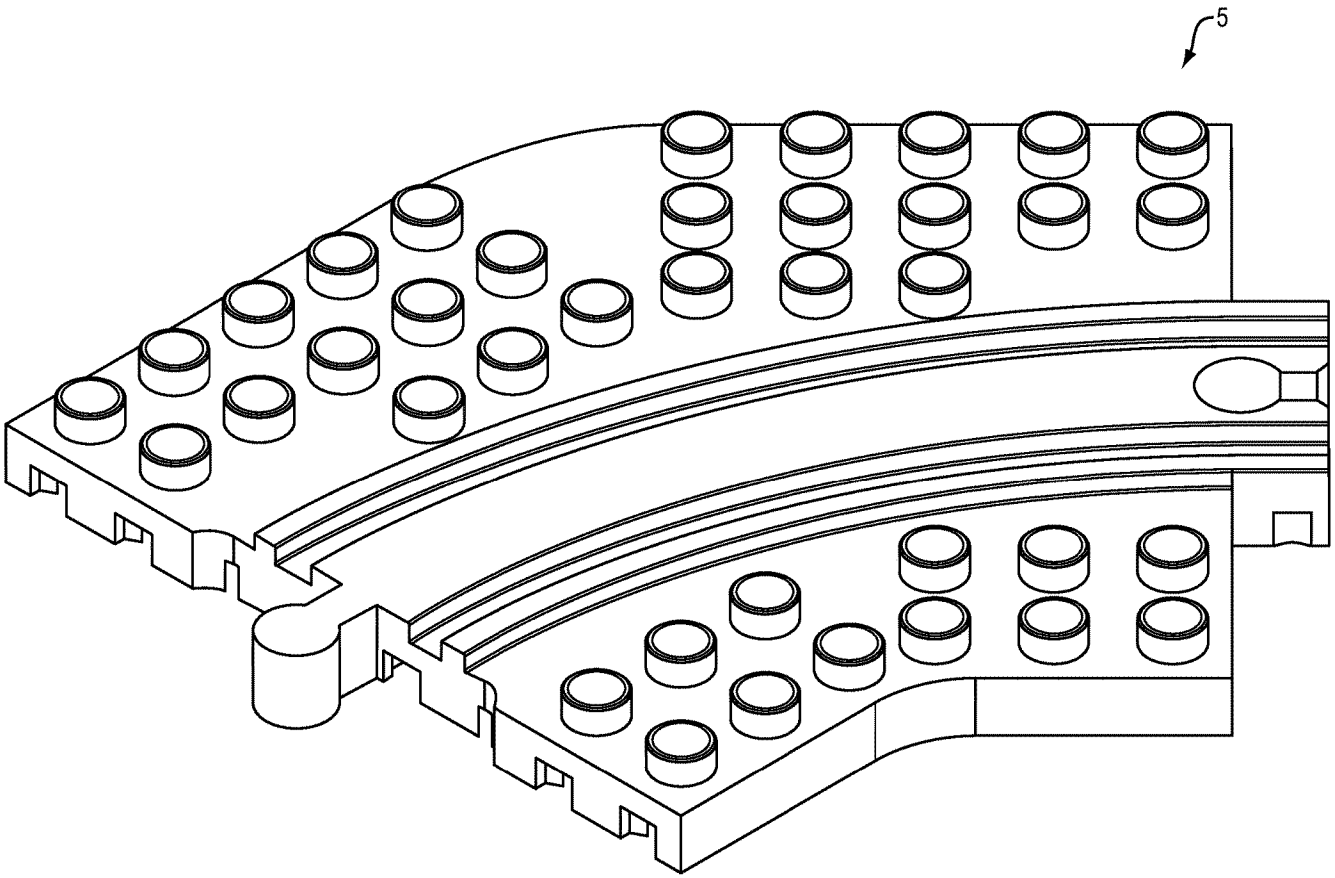
FIG. 18 illustrates a track element having wheel engagement elements disposed in a substantially 45° curve.
Figure 19:
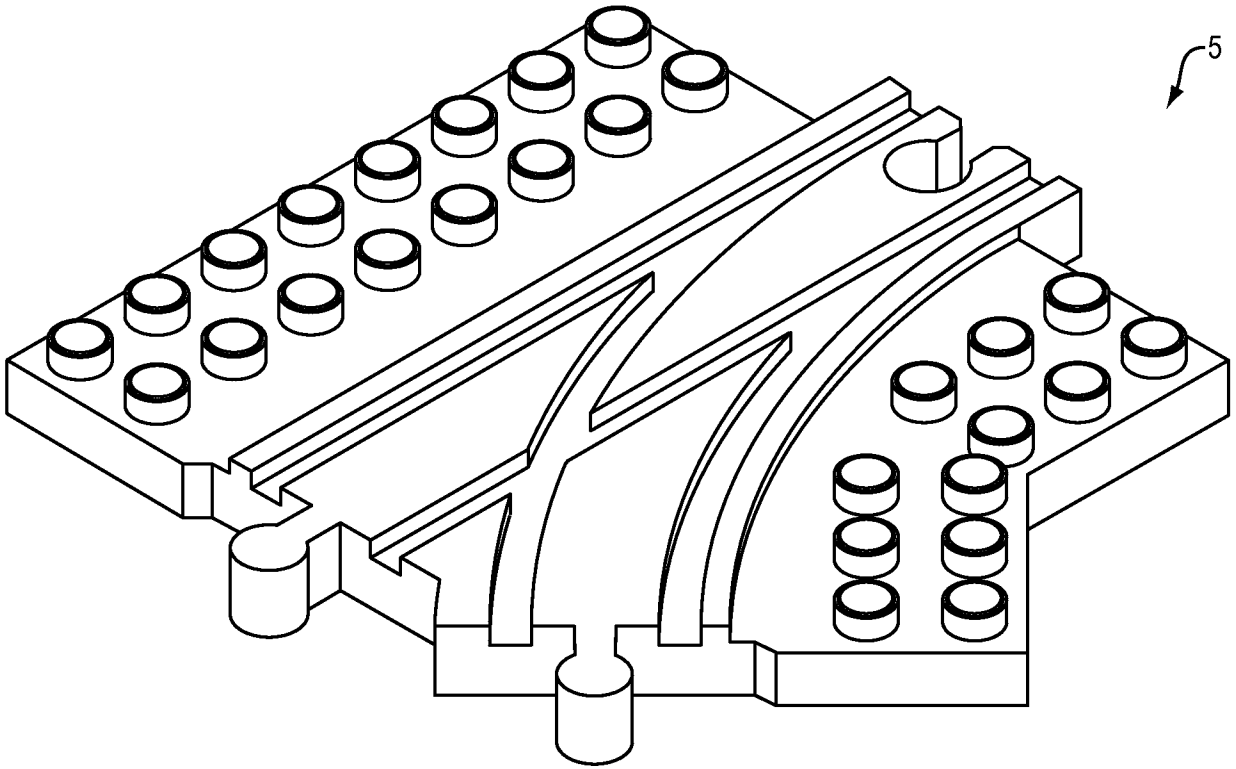
FIG. 19 illustrates a track element having wheel engagement elements disposed in a Y-configuration.
Figure 20:
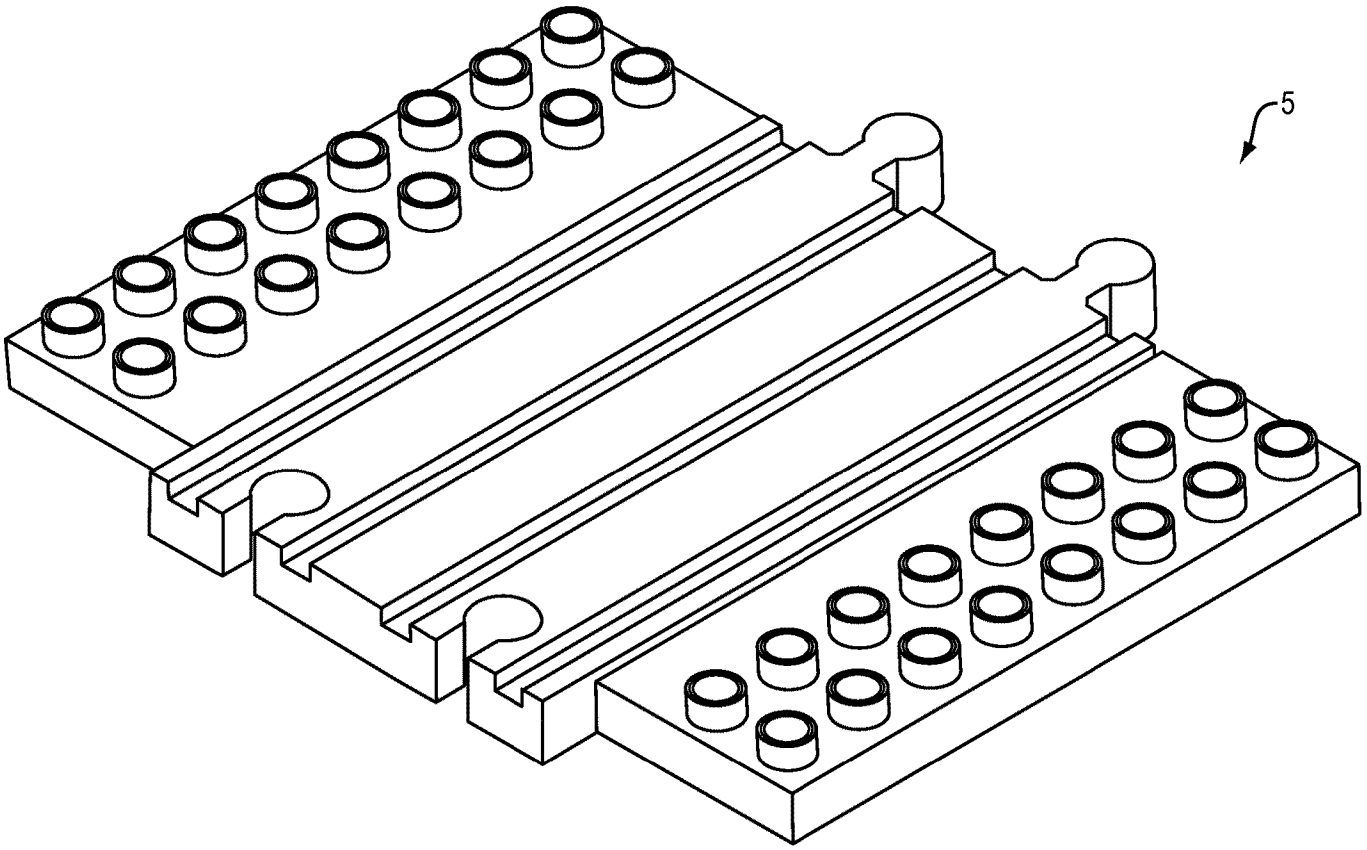
FIG. 20 illustrates a track element having wheel engagement elements disposed in a one-way double track configuration.
Figure 21:
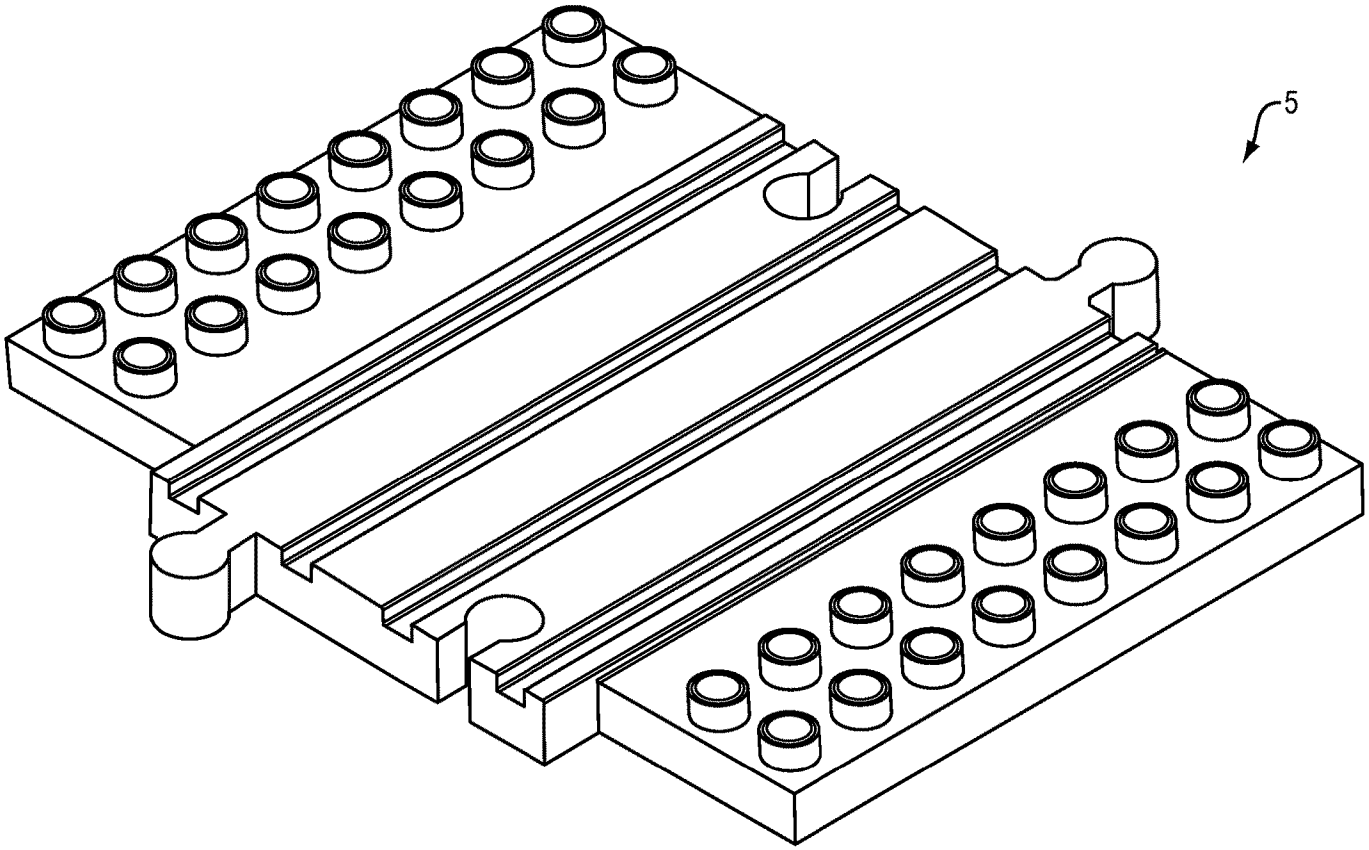
FIG. 21 illustrates a track element having wheel engagement elements disposed in a two way double track configuration.
Figure 22:
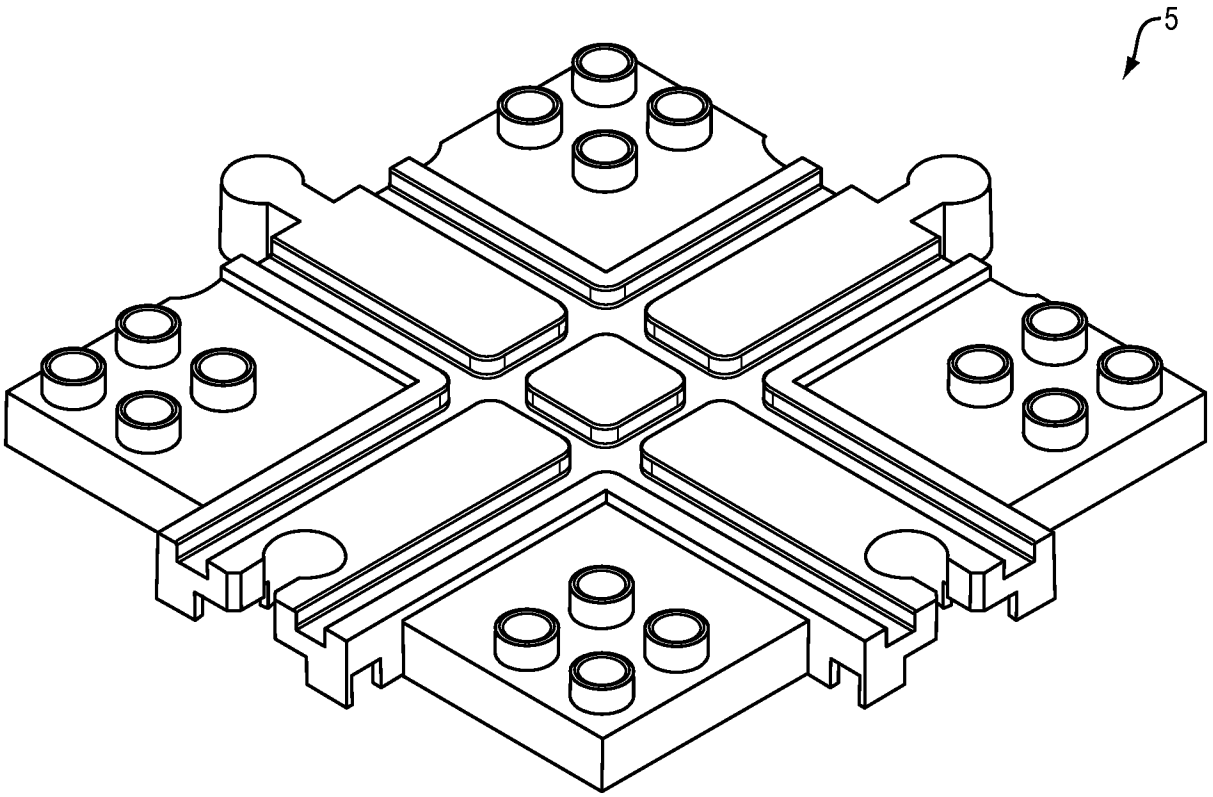
FIG. 22 illustrates a track element having wheel engagement elements disposed in a cross-track configuration.

As indicated above, the track element 5 is configured with wheel engagement elements 20 that extend substantially parallel to the longitudinal axis of the base 6. Such indication is by way of example, only. In one arrangement, the wheel engagement elements 20 are disposed in a substantially 90° curve (FIG. 17), in a substantially 45° curve (FIG. 18), in a Y-configuration (FIG. 19), in a one-way double track configuration (FIG. 20), in a two-way double track configuration (FIG. 21), or in a cross-track configuration (FIG. 22).

What is claimed is:

1. A track element, comprising:

a base having a first side and a second side opposing the second side, the first side of the base defining a set of wheel engagement elements extending between a first end and a second end of the base and the second side of the base defining a first locking block receptacle at the first end of the base and a second locking block receptacle at the second end of the base;

a first track element connector disposed at the first end of the base;

a second track element connector disposed at the second end of the base;

the first locking block receptacle configured to receive projections of a first locking block disposed in proximity to an edge of the first locking block to define a horizontally oriented first support area of the first locking block along a first offset distance from the first sidewall of the base to the edge of the first locking block to support a first track piece coupled to the first track element connector, the first support area being free of projections of the first locking block; and the second locking block receptacle configured to receive projections of a second locking block disposed in proximity to an edge of the second locking block to define a horizontally oriented second support area of the second locking block to support a second track piece coupled to the second track element connector, the second support area being free of projections of the second locking block.

2. The track element of claim 1, wherein:

the first track element connector comprises a male connector element extending from a first sidewall of the base.

3. The track element of claim 2, wherein the first support area is configured to support a female connector element end of the first track piece.

4. The track element of claim 1, wherein:

the second track element connector comprises a female connector element defined by a second sidewall of the base; and the second support area of the second locking block is defined along a second offset distance from the second sidewall of the base to the edge of the second locking block to support the second track piece coupled to the second track element connector.

5. The track element of claim 4, wherein the second support area is configured to support a male connector element end of the first track piece.

6. The track element of claim 1, wherein the base further comprises a first platform portion extending along a first lateral direction relative to a longitudinal axis of the base.

7. The track element of claim 6, wherein the first platform portion of the base has a first side and a second side opposing the second side, the first side of the base comprising a set of first platform portion locking block projections and the second side of the base defining a set of first platform portion locking block receptacles.

8. The track element of claim 6, wherein the base further comprises a second platform portion extending along a second lateral direction relative to the longitudinal axis of the base, the second lateral direction opposing the first direction.

9. The track element of claim 8, wherein the second platform portion of the base has a first side and a second side opposing the second side, the first side of the base comprising a set of second platform portion locking block projections and the second side of the base defining a set of second platform portion locking block receptacles.

10. The track element of claim 1, wherein the set of wheel engagement elements define a first channel and a second channel, each of the first channel and second channel extending between the first end of the base and the second end of the base.

11. A track system, comprising:

a base having a first side and a second side opposing the second side, the first side of the base defining a set of wheel engagement elements extending between a first end and a second end of the base and the second side of the base defining a first locking block receptacle at the first end of the base and a second locking block receptacle at the second end of the base;

a first track element connector disposed at the first end of the base;

a second track element connector disposed at the second end of the base;

a first locking block coupled to the first locking block receptacle, the first locking block receptacle configured to receive projections of the first locking block disposed in proximity to an edge of the first locking block to define a horizontally oriented first support area of the first locking block along a first offset distance from the first sidewall of the base to the edge of the first locking block to support a first track piece coupled to the first track element connector, the first support area being free of projections of the first locking block; and a second locking block coupled to the second locking block receptacle, the second locking block receptacle configured to receive projections of a second locking block disposed in proximity to an edge of the second locking block to define a horizontally oriented second support area of the second locking block to support a second track piece coupled to the second track element connector, the second support area being free of projections of the second locking block.

12. The track system of claim 11, wherein:

the first track element connector comprises a male connector element extending from a first sidewall of the base.

13. The track system of claim 12, wherein the first support area is configured to support a female connector element end of the first track piece.

14. The track system of claim 11, wherein:

the second track element connector comprises a female connector element defined by a second sidewall of the base; and the second support area of the second locking block is defined along a second offset distance from the second sidewall of the base to the edge of the second locking block to support the second track piece coupled to the second track element connector.

15. The track system of claim 14, wherein the second support area is configured to support a male connector element end of the first track piece.

16. The track system of claim 11, wherein the base further comprises a first platform portion extending along a first lateral direction relative to a longitudinal axis of the base.

17. The track system of claim 16, wherein the first platform portion of the base has a first side and a second side opposing the second side, the first side of the base comprising a set of first platform portion locking block projections and the second side of the base defining a set of first platform portion locking block receptacles.

18. The track system of claim 16, wherein the base further comprises a second platform portion extending along a second lateral direction relative to the longitudinal axis of the base, the second direction opposing the first direction.

19. The track system of claim 18, wherein the second platform portion of the base has a first side and a second side opposing the second side, the first side of the base comprising a set of second platform portion locking block projections and the second side of the base defining a set of second platform portion locking block receptacles.

20. A track element, comprising:

a base having a first side and a second side opposing the second side, the first side of the base defining a set of wheel engagement elements extending between a first end and a second end of the base and the second side of the base defining a first locking block receptacle at the first end of the base and a second locking block receptacle at the second end of the base;

a first track element connector disposed at the first end of the base;

a second track element connector disposed at the second end of the base;

the first locking block receptacle configured to receive projections of a first locking block disposed in proximity to an edge of the first locking block to define a horizontally oriented first support area of the first locking block along a first offset distance from the first sidewall of the base to the edge of the first locking block to support a first track piece coupled to the first track element connector, the first support area being free of projections of the first locking block;

the second locking block receptacle configured to receive projections of a second locking block disposed in proximity to an edge of the second locking block to define a horizontally oriented second support area of the second locking block to support a second track piece coupled to the second track element connector, the second support area being free of projections of the second locking block;

a first platform portion extending along a first lateral direction relative to a longitudinal axis of the base, wherein the first platform portion of the base has a first side and a second side opposing the second side, the first side of the base comprising a set of first platform portion locking block projections and the second side of the base defining a set of first platform portion locking block receptacles; and a second platform portion extending along a second lateral direction relative to the longitudinal axis of the base, the second direction opposing the first direction, wherein the second platform portion of the base has a first side and a second side opposing the second side, the first side of the base comprising a set of second platform portion locking block projections and the second side of the base defining a set of second platform portion locking block receptacles.

* * * * *